United States Patent [19]

Schwenke

[11] 3,957,156

[45] May 18, 1976

[54] APPARATUS FOR INVERTING CIGARETTES OR THE LIKE

[75] Inventor: Dieter Schwenke, Hamburg, Germany

[73] Assignee: Hauni-Werke Körber & Co., KG, Hamburg, Germany

[22] Filed: Sept. 13, 1974

[21] Appl. No.: 505,951

[30] Foreign Application Priority Data

Sept. 15, 1973 Germany ..... 2346511

[52] U.S. Cl. ..... 198/235; 198/34

[51] Int. Cl.² ..... B65G 47/24

[58] Field of Search ..... 198/206, 34, 31, 32, 198/39, 235

[56] References Cited

UNITED STATES PATENTS

| | | | |
|---|---|---|---|
| 2,346,421 | 4/1944 | Gantzer | 198/34 |
| 2,509,725 | 5/1950 | Dalton | 198/235 |
| 3,319,764 | 5/1967 | Gamberini | 198/235 |
| 3,405,579 | 10/1968 | London | 198/32 |
| 3,417,855 | 12/1968 | Liedtke | 198/32 |

*Primary Examiner*—James B. Marbert
*Attorney, Agent, or Firm*—Peter K. Kontler; John Kurucz

[57] ABSTRACT

A turn-around device for filter cigarettes wherein alternate flutes of a rotary drum-shaped conveyor transport pairs of filter cigarettes in such a way that the filter tips of each pair of cigarettes are adjacent to each other. One cigarette of each of successive pairs of filter cigarettes is transferred into one of two flutes of one of an annulus of inverting elements which are rotatably mounted on a rotary turntable. The turntable completes one full revolution about its axis while an inverting element completes one-half of a revolution counter to the direction of rotation of the turntable and about a second axis which is parallel to the axis of the turntable whereby a cigarette on the inverting element is automatically turned end-for-end when the inverting element returns to the station where its one flute has received a cigarette from the conveyor. The inverted cigarette is inserted into an empty flute of the conveyor in front of a first and behind a second non-inverted cigarette. The other flute of the inverting element simultaneously receives a non-inverted cigarette, and such cigarette is inverted during the next revolution of the turntable.

25 Claims, 6 Drawing Figures

APPARATUS FOR INVERTING CIGARETTES OR THE LIKE

BACKGROUND OF THE INVENTION

The present invention relates to improvements in turn-around devices for cigarettes or analogous rod-shaped articles. More particularly, the invention relates to improvements in devices which can turn cigarettes or the like end-for-end, for example, to change the orientation of filter-tipped cigarettes or to change the orientation of cigarettes which are provided with printed matter representing the name of the manufacturer, the brand name, the trademark of the manufacturer or other information.

A filter cigarette making machine normally produces filter cigarettes of double unit length wherein a filter rod section of double unit length is located between two plain cigarettes of unit length. Such filter cigarettes are thereupon severed midway between their ends to yield pairs of coaxial filter cigarettes of unit length whose filter tips are adjacent to each other. One filter cigarette of each pair is inverted or turned around end-for-end so that the filter tips of all cigarettes face in the same direction. This is advisable because the filter cigarettes of unit length are thereupon examined for the condition of their tobacco-containing ends and also because such cigarettes must be packed in such a way that all of the filter tips face in the same direction. As a rule, a turn-around device for filter cigarettes of unit length is designed to place the inverted cigarettes into the spaces between the non-inverted cigarettes so that the inverted and non-inverted cigarettes form a single row which consists of parallel cigarettes and wherein each preceding cigarette is in exact alignment with the next-following cigarette.

A presently known turn-around device for cigarettes comprises a turntable with radially extending flutes for cigarettes. A first rotary drum-shaped conveyor delivers cigarettes into successive flutes at a first transfer station and the cigarettes thereupon travel with the turntable along an arc of 180° prior to being transferred (at a second transfer station) onto a second drum-shaped conveyor which is coaxial with the first conveyor but is driven in the opposite direction. A drawback of such turn-around device is that, when the number of cigarettes to be inverted unit of time is very high, the intervals for transfer of cigarettes from the first conveyor onto the turntable and from the turntable onto the second conveyor are extremely short. Moreover, the cigarettes are likely to be damaged or destroyed if the speed of the turntable and/or of the first or second conveyor deviates only slightly from a predetermined speed.

It is also known to invert cigarettes during travel with a turntable which carries pivotable channel-shaped holders for cigarettes. The holders receive cigarettes from a first conveyor at a first station and deliver inverted cigarettes to a second conveyor at a second station.

SUMMARY OF THE INVENTION

An object of the invention is to provide a simple, compact and rugged turn-around device for cigarettes or like rod-shaped articles which can change the orientation of large numbers of rod-shaped articles per unit of time, which can invert rod-shaped articles end-for-end in a small area, and which does not deform, deface and/or otherwise adversely affect the appearance or condition of articles during turning.

Another object of the invention is to provide a novel and improved turn-around device of the type wherein the articles to be inverted end-for-end are transported by a rotary turntable.

A further object of the invention is to provide improved means for feeding non-inverted articles to and for receiving inverted articles from the turntable.

An additional object of the invention is to provide a turn-around device which can be installed in existing machines for the making or processing of rod-shaped articles, especially plain or filter-tipped cigarettes, cigars or cigarillos.

Still another object of the invention is to provide a turn-around device which is constructed and assembled in such a way that the articles which are in the process of being tunred end-for-end cannot interfere with each other and that the articles are subjected to the action of a relatively weak centrifugal force in spite of the fact that the turning takes place by resorting to a turntable.

The improved turn-around device can be used to invert cigarettes or analogous rod-shaped articles, particularly to invert one filter cigarette of each of a succession of pairs of coaxial filter cigarettes of unit length which move sideways. The device comprises a turntable or an analogous support which is rotatable about a first axis (e.g., about a vertical axis), reorienting means including at least one inverting element which is mounted on and is rotatable relative to the support about a second axis spaced from and parallel to the first axis, means for rotating the support in a first direction whereby the inverting element orbits about the first axis and moves past a transfer station once during each revolution of the support, means for rotating the inverting element about the second axis counter to the direction of rotation of the support and through 180° during each full revolution of the support, means for feeding non-inverted articles to the inverting element at the transfer station whereby an article which has been fed to the inverting element at the transfer station is automatically turned around end-for-end during the next-following full revolution of the support, and means for accepting and removing inverted articles from the inverting element at the transfer station. The feeding means may comprise a rotary drum-shaped conveyor which is rotatable about a third axis normal to the first and second axes and which may also constitute the aforementioned removing means.

The inverting element is preferably provided with pairs of receiving means in the form of flutes one of which delivers an inverted article to the removing means while the other flute receives a non-inverted article. Upon completion of the next full revolution of the support, the other flute delivers an inverted article to the removing means while the one flute receives a non-inverted article from the feeding means.

The novel features which are considered as characteristic of the invention are set forth in particular in the appended claims. The improved turn-around device itself, however, both as to its construction and its mode of operation, together with additional features and advantages thereof, will be best understood upon perusal of the following detailed description of certain specific embodiments with reference to the accompanying drawing.

BRIEF DESCRIPTION OF THE PREFERRED EMBODIMENTS

Figure 1:
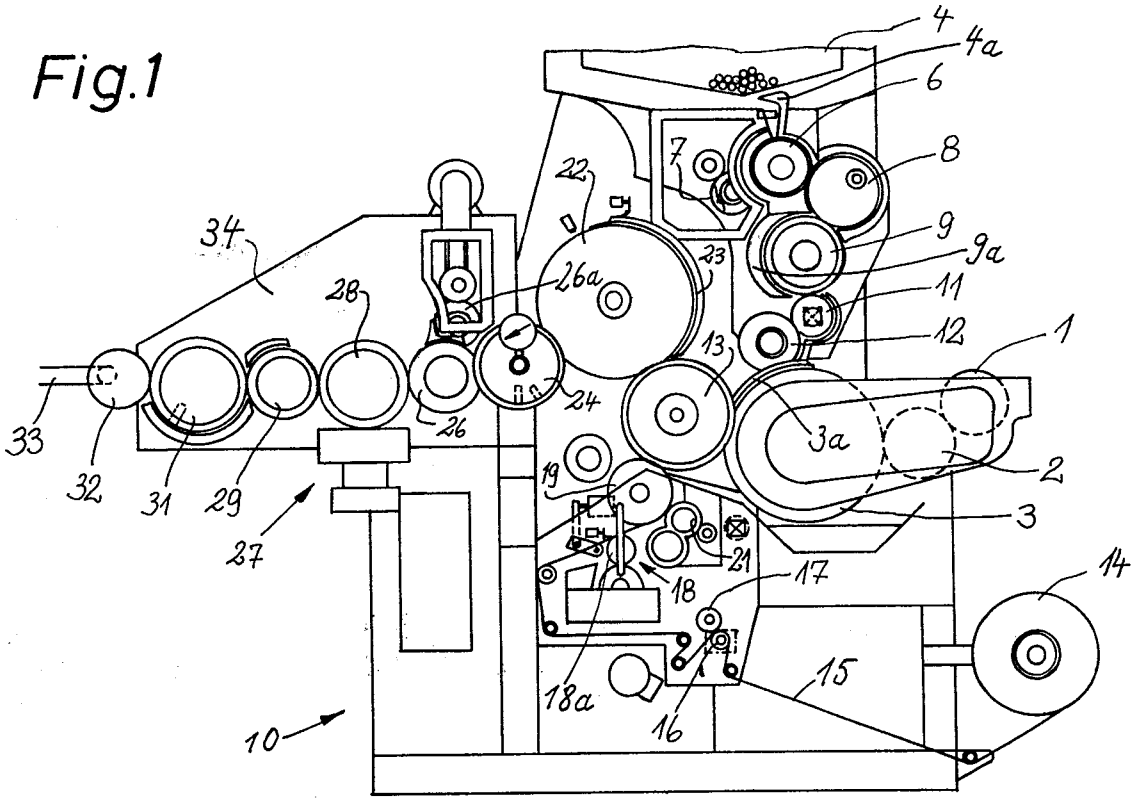
FIG. 1 is a schematic elevational view of a filter cigarette making machine including a turn-around device which embodies the invention.

FIG. 1 shows a filter cigarette making machine of the type known as "MAX" (trademark) produced by Hauni-Werke, Körber & Co. K.G., of Hamburg-Bergedorf, Western Germany. This machine is directly coupled to a cigarette rod making maching (e.g., of the type known as "GARANT" (trademark) also produced by Hauni-Werke) which includes a rotary drum-shaped row forming conveyor 1 serving to form and transport two rows of plain cigarettes of unit length sideways in such a way that the cigarettes of one row are staggered with respect to the cigarettes of the other row (as considered in the circumferential direction of the conveyor 1). The conveyor 1 has a cylindrical peripheral surface formed with flutes which are parallel to its axis and each of which receives a single plain cigarette of unit length. The cigarettes of one row are adjacent to one axial end and the cigarettes of the other row are adjacent to the other axial end of the peripheral surface.

The filter cigarette making machine has a frame 10 which supports two coaxial rotary drum-shaped aligning conveyors 2 (only one shown). Each aligning conveyor 2 receives from the conveyor 1 a row of plain cigarettes of unit length. The speed at which one of the aligning conveyors 2 is driven is different from the speed of the other aligning conveyor (and/or the distance through which one of the conveyors 2 transports plain cigarettes is different from the distance through which the other conveyor 2 transports the cigarettes of the respective row) so that each cigarette of one row is coaxial with a cigarette of the other row before or not later than when the thus obtained pairs of aligned plain cigarettes of unit length are transferred into successive flutes of a rotary drum-shaped assembly conveyor 3 which is mounted in the frame 10. One plain cigarette of each pair is spaced apart from the other cigarette of the respective pair so that such cigarettes are separated from each other by a gap having a length which at least equals and normally slightly exceeds the length of a filter rod section of double unit length.

The upper end portion of the frame 10 supports a magazine or hopper 4 for a supply of parallel filter rod sections of six times unit length. The lower end portion of the magazine 4 communicates with a downwardly extending chute **4*a* which contains a single column of descending filter rod sections and the lower end of which feeds discrete filter rod sections into successive flutes of a rotary drum-shaped severing conveyor 6 cooperating with two rapidly rotating disk-shaped knives 7 which sever each filter rod section of six times unit length so that the latter yields a group of three coaxial filter rod sections of double unit length. Each filter rod section of a group is accepted by one of three rotary drum-shaped staggering conveyors 8 which are driven at different speeds and/or transport the respective filter rod sections of double unit length through different distances so that the filter rod sections of a group are staggered (as considered in the circumferential direction of the staggering conveyor 8 shown in FIG. 1) prior to transfer into successive flutes of a rotary drum-shaped shuffling conveyor 9. The latter cooperates with one or more stationary cams 9*a* to shift some or all of the filter rod sections of double unit length so that such sections form a single row wherein each preceding section is in exact alignment with the next-following section. The shuffling conveyor 9 delivers filter rod sections of the thus obtained row into successive flutes of a rotary drum-shaped intermediate conveyor 11 which transfers the sections into successive flutes of a rotary drum-shaped accelerating conveyor 12. The latter inserts a filter rod section of double unit length into each flute of the assembly conveyor 3 whereby each of these flutes contains a group of three coaxial rod-shaped articles including two spaced-apart plain cigarettes of unit length and a filter rod section of double unit length therebetween. The assembly conveyor 3 transports such groups past two stationary condensing cams 3*a*** which cause one or both plain cigarettes of each group to move axially toward the respective filter rod section so that each group is converted into a shorter group wherein the inner end faces of plain cigaretes abut against the respective end faces of the filter rod section.

The thus condensed or shortened groups are admitted into successive flutes of a rotary drum-shaped transfer conveyor 13 which cooperates with a rotary suction drum 19 to apply to each group an adhesive-coated uniting band. The uniting bands are obtained in response to severing of the leader of an elongated web 15 of cigarette paper, imitation cork or the like which is being drawn from a bobbin 14 by two advancing rolls 16, 17 and is caused to travel along the periphery of a rotary applicator **18*a* forming part of a paster 18. The latter has a tank for a supply of adhesive which is applied to the underside of the web 15. The suction drum 19 attracts the uncoated side of and advances the leader of the adhesive-coated web and cooperates with a rotary knife 21 which severs the leader at regular intervals to form a succession of discrete uniting bands. Each uniting band is attached to a group of rod-shaped articles in the adjacent flute of the transfer conveyor 13 in such a way that the uniting band contacts the respective filter rod section of double unit length and the adjacent inner end portions of the respective plain cigarettes. The conveyor 13 transfers successive groups (each of which carries a uniting band) onto a rotary drum-shaped wrapping conveyor 22 which cooperates with a stationary or driven rolling device 23** to convolute the uniting bands around the respective filter rod sections of double unit length and around the inner end portions of the respective plain cigarettes whereby each such group forms a filter cigarette of double unit length.

The wrapping conveyor 22 delivers filter cigarettes of double unit length into successive flutes of a rotary drum-shaped conveyor 24 forming part of a first testing unit which monitors the condition of wrappers of filter cigarettes (i.e., the presence or absence of open seams, holes and/or other defects) and effects immediate or delayed segregation of defective filter cigarettes of double unit length from satisfactory filter cigarettes. At least the satisfactory filter cigarettes of double unit length are thereupon transferred into successive flutes 26A (see FIG. 2) of a rotary drum-shaped severing conveyor 26 which cooperates with a rapidly rotating disk-shaped knife 26*a* to sever each filter cigarette of double unit length midway between the respective plain cigarettes so that each such cigarette yields two coaxial filter cigarettes 77 (see FIG. 2) of unit length. Each filter cigarette 77 of unit length consists of a plain cigarette of unit length, a filter rod section or filter plug of unit length, and one-half of a convoluted uniting band.

The thus obtained pairs of coaxial filter cigarettes 77 of unit length are thereupon transferred into alternate flutes 28A (see FIG. 2) of a rotary drum-shaped conveyor 28 forming part of an improved turn-around device 27. The purpose of the turn-around device 27 is to invert one filter cigarette 77 of each pair end-for-end and to place the inverted cigarette between two non-inverted cigarettes 77 so that the cigarettes form a single row wherein the filter rod sections face in the same direction. The inverted cigarettes 77A (FIG. 2) are placed into the previously unoccupied flutes 28A of the conveyor 28 and the latter thereupon delivers cigarettes 77 and 77A into successive flutes 29A (FIG. 2) of a rotary drum-shaped intermediate conveyor 29. The conveyor 29 delivers cigarettes 77 and 77A into successive flutes of a rotary drum-shaped conveyor 31 forming part of a second testing unit which monitors the density of the tobacco-containing ends of cigarettes 77 and 77A and effects an immediate or delayed segregation of cigarettes with unsatisfactory tobacco-containing ends. At least the satisfactory cigarettes 77 and 77A are introduced into successive flutes a rotary drum-shaped transfer conveyor 32 which deposits the cigarettes onto the upper stretch of an endless take-off belt conveyor 33. The latter can deliver cigarettes 77 and 77A directly to the magazine of a packing machine, to a tray filling apparatus, or into storage.

Figure 2:
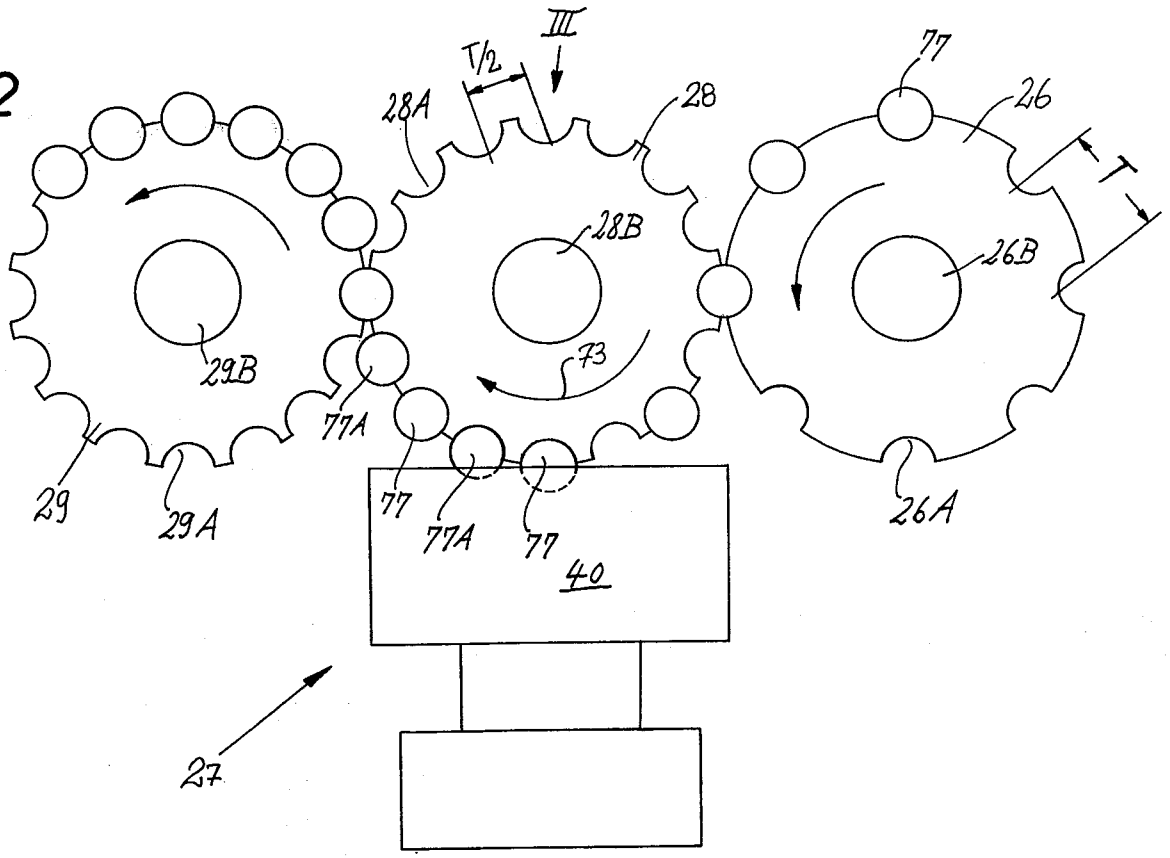
FIG. 2 is an enlarged schematic elevational view of the turn-around device and of two conveyors one of which supplies articles to and the other of which receives articles from a conveyor of the turn-around device.
Figure 4:
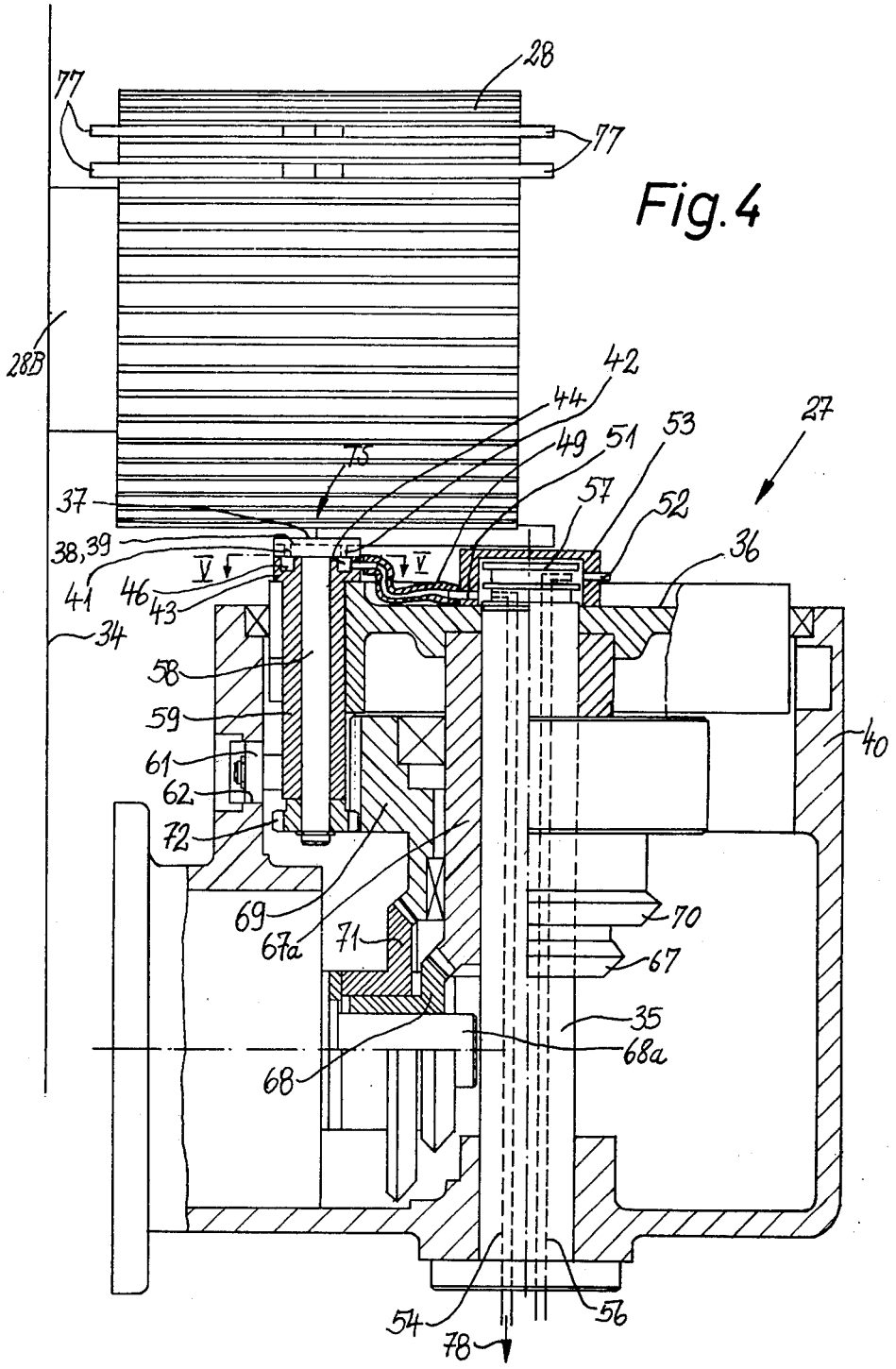
FIG. 4 is a partly side elevational and partly vertical sectional view of the turn-around device, the section being taken in the direction of arrows as seen from the line IV—IV of FIG. 3.
Figure 6:
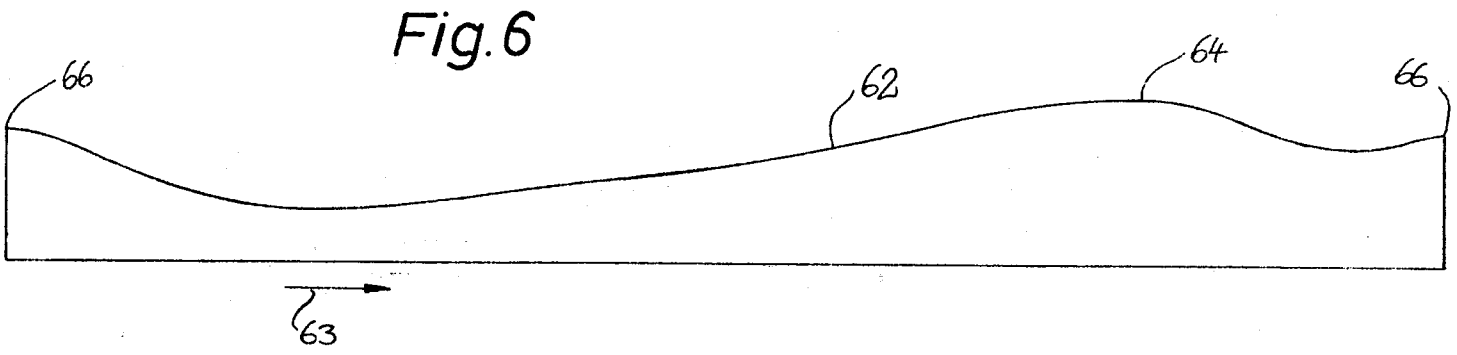
FIG. 6 is a developed view of a stationary cam in the turn-around device.

The shafts 26B, 28B, 29B of the conveyors 26, 28, 29 shown in FIG. 2 are horizontal, parallel to each other, and journalled in an upright frame member or wall 34 of the frame 10. These shafts are driven in synchronism so that the flutes 26A, 28A, 29A travel at the same speed. The distance T between the centers of two neighboring flutes 26A in the periphery of the conveyor 26 is twice the distance (T/2) between the centers of neighboring flutes 28A or 29A. All of the flutes 26A, 28A, 29A are parallel to the respective shafts 26B, 28B, 29B. As shown in FIGS. 2 and 4, the major part of the turn-around device 27 is mounted at a level below the conveyor 28, and more particularly below that half of the conveyor 28 which is remote from the frame member 34.

The just mentioned major part of the turn-around device 27 comprises a housing or case 40 which is mounted on the frame member 34 or on another portion of the frame 10 and is open at the top (below the conveyor 28) so that it can receive a portion of a rotary support 36 here shown as a turntable rigid with a vertical shaft 35 which is journalled in the housing 40. Thus, the axis about which the turntable 36 rotates is normal to the axis of the shaft 28B for the conveyor 28. The upper side of the turntable 36 supports at least one but preferably a complete annulus of closely adjacent inverting or reorienting elements 37 each of which is rotatable relative to the turntable about a vertical axis parallel to the axis of the shaft 35. Thus, when the shaft 35 rotates the turntable 36, the inverting elements 37 orbit about the axis of the shaft 35 and can rotate about their respective axes. The inverting elements 37 are equally spaced from each other and from the axis of the shaft 35.

It is preferred to employ a turntable having a relatively small diameter and to provide a reorienting means consisting of a large number of inverting elements 37 which are closely adjacent to each other. This allows for a reduction of the speed of turntable (about the axis of the shaft 35) and of the speed of inverting elements 37 about their respective axes while allowing for turning a large number of cigarettes 77 per unit of time.

Figure 3:
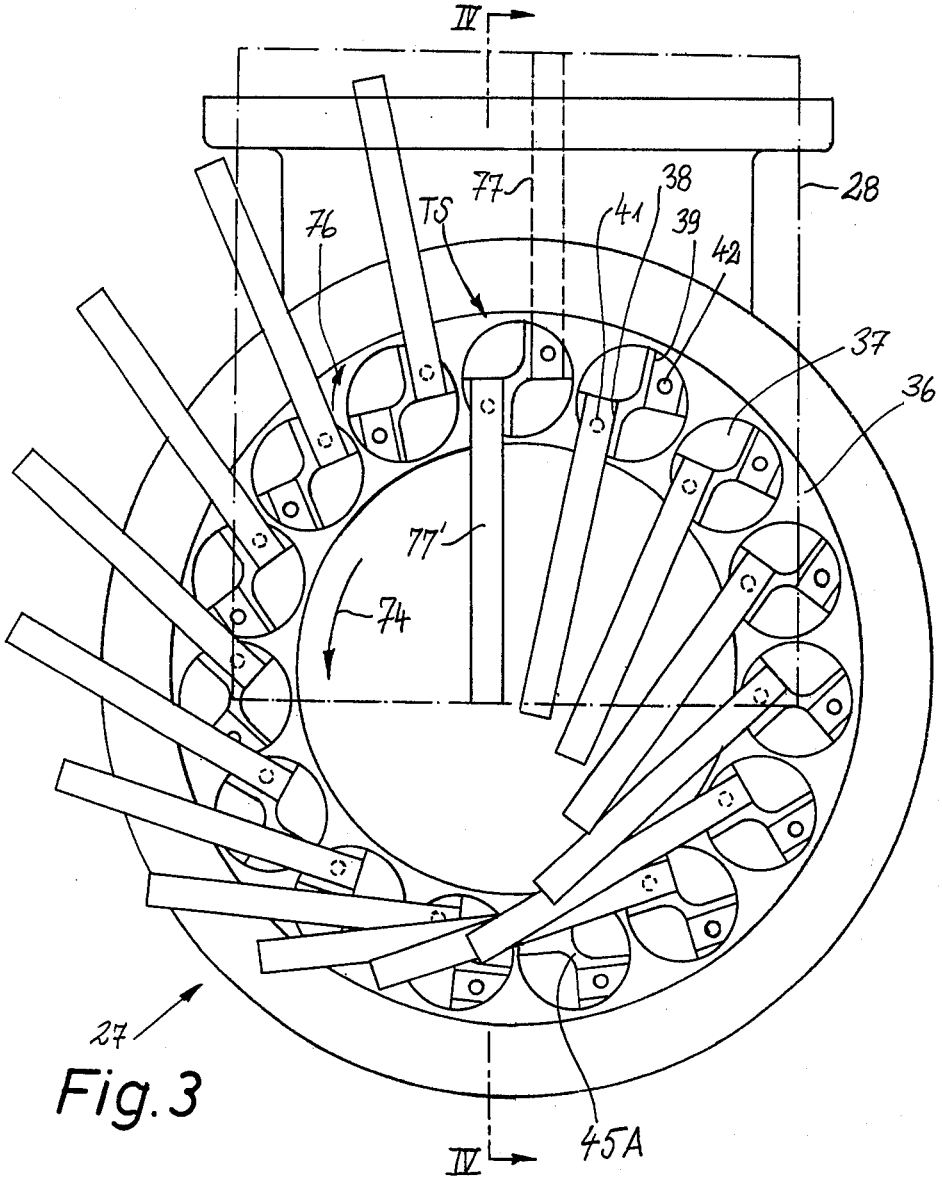
FIG. 3 is an enlarged plan view of the turn-around device as seen in the direction of arrow III in FIG. 2, with the conveyor of the turn-around device indicated by phantom lines.

The upper side of each inverting element 37 is formed with two parallel article-receiving flutes 38, 39 which flank the axis of the respective inverting element and form part of a substantially Z-shaped recess 45A. As shown in FIG. 3, the open ends of the flutes 38, 39 face in opposite directions (with respect to the axis of the corresponding inverting element 37) and the length of each flute in an inverting element is only a small fraction of the length of a cigarette 77. Thus, only an end portion of a cigarette 77 can be held in a flute 38 or 39 during transport from and back to a transfer station TS where a flute 38 receives a non-inverted cigarette while the associated flute 39 delivers an inverted cigarette 77A to the conveyor 28, or vice versa. Each inverting element 37 is further provided with two suction ports 41, 42 which respectively communicate with the deepmost regions of the corresponding flutes 38, 39. It is clear that each flute can communicate with two or more suction ports.

Figure 5:
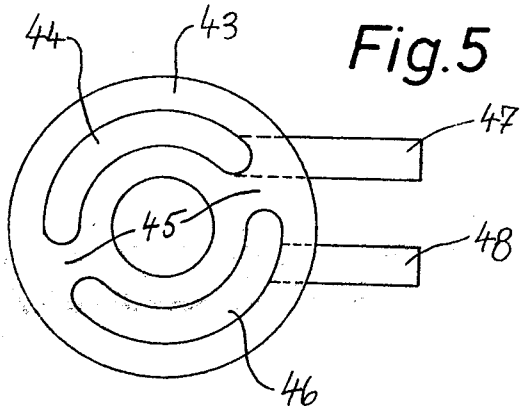
FIG. 5 is an enlarged plan view of a valve member for one of the inverting elements in the turn-around device of FIGS. 2–4 substantially as seen in the direction of arrows from the line V—V of FIG. 4.

The inverting elements 37 are rotatable above valve plates 43 (one shown in detail in FIG. 5) which are non-rotatably mounted in the turntable 36 and each of which has two mirror symmetrical arcuate grooves 44, 46 respectively communicating with suction pipes 47, 48. The pipes 47, 48 are respectively connected with nipples 51, 52 of a distributor or manifold 53 which is coaxial and rotates with the turntable 36. The connections between the pipes 46, 47 and nipples 51, 52 comprise flexible conduits 49, two for each inverting element 37. The shaft 35 for the turntable 36 is formed with two axially extending channels or bores 54, 56 (FIG. 4) which are connected to a suitable suction generating device, e.g., to the inlet of a fan. The upper end of the bore 54 communicates with the nipples 51 and the upper end of the bore 56 communicates with the nipples 52 of the manifold 53. The latter is rigid with and sealingly engages the shaft 35 and/or the turntable 36 to prevent uncontrolled inflow of atmospheric air into the bores 54, 56. FIG. 3 shows that the shaft 35 for the turntable 36 comprises an upwardly extending portion or head 57 which has inlets communicating with the bores 54, 56 and is sealingly surrounded by the manifold 53.

The means for rotating the inverting elements 37 with respect to the turntable 36 comprises drive shafts 58 which are rotatable in upright bearing sleeves 59. Each sleeve 59 is rigid with the respective valve plate 43 and has a roller follower 61 tracking the face of a cam 62 in the housing 40. The sleeves 59 cannot rotate in but are movable axially relative to the turntable 36. The shafts 58 share all axial movements of the respective sleeves 59, i.e., when the turntable 36 rotates about the axis of the shaft 35, the inverting elements 37 move up and down in the direction of their respective axes because the followers 61 track the stationary cam 62. The axes of the roller followers 61 are horizontal and normal to the axis of the shaft 35, i.e., the axis of each follower 61 extends radially of the turntable 36.

The cam 62 may constitute a discrete component which is separably affixed to the housing 40. In the embodiment which is shown in FIGS. 2 to 6, the cam 62 is machined directly into the housing 40 and has an endless cam face or track which is shown (in a developed view) in FIG. 6. The direction in which the turntable 36 is driven by the shaft 35 relative to the housing 40 is indicated by an arrow 63 (see FIG. 6). The face of the cam 62 has a first apex 64 and a second apex 66. When an inverting element 37 is located at the transfer station TS between the turntable 36 and conveyor 28, the respective roller follower 61 engages the apex 66. The face of the cam 62 thereupon slopes downwardly so that the inverting element 37 descends during movement beyond and away from the station TS. After the inverting element 37 assumes or approaches the 3 o'clock position of FIG. 3 (i.e., after an angular displacement through approximately 90 degrees beyond the transfer station TS), the face of the cam 62 begins to slope upwardly along an arc of approximately 180° so that the respective roller follower 61 moves upwardly (and gradually lifts the associated inverting element) during travel toward the apex 64. From there on, the roller follower 61 gradually descends to a level slightly below and thereupon returns to the level of the apex 66 when the respective inverting element 37 returns to the station TS, i.e., in response to one complete revolution of the turntable 36 about the axis of the shaft 35.

Each inverting element 37 rotates about the axis of its shaft 58 in a clockwise direction (arrow 76 in FIG. 3) while the turntable 36 rotates in a counterclockwise direction (arrow 74 in FIG. 3) or vice versa. Also, while the turtable 36 completes a full revolution, an inverting element 37 completes one-half of a full revolution about its own axis. Thus, the direction in which the elements 37 rotate about the axes of their respective shafts 58 is counter to the direction of rotation of the turntable 36, and the angular displacement of each inverting element about its own axis is one-half the angular displacement of the turntable about the axis of shaft 35.

The means for rotating the shaft 35 (and hence the turntable 36) comprises a first torque transmitting member here shown as a bevel gear 67 which has an elongated sleeve-like portion 67*a* surrounding a substantial length of the shaft 35 in the housing 40 and being rigid with the turntable 36 and/or shaft 35. The bevel gear 67 meshes with a second bevel gear 68 which extends into the housing 40 and is rotatable about a horizontal axis. The shaft 68*a* which drives the bevel gear 68 extends rearwardly through and beyond the frame member 34 and receives torque from the main prime mover of the filter cigarette making machine.

The means for rotating the shafts 58 comprises a second torque transmitting member including a gear cluster having a spur gear 69 in mesh with pinions 72 at the lower ends of the shafts 58 and a bevel 70 which meshes with a bevel gear 71. The latter surrounds the bevel gear 68 and is driven by the prime mover of the filter cigarette making machine in a manner not shown in FIG. 4. The spur gear 69 surrounds and is rotatable relative to the sleeve 67*a* of the bevel gear 67. The housing 40 further contains suitable anti-friction and/or friction bearings for the rotary parts including the turntable 36, shafts 35, 58, gears 69–70, sleeves 59 and others. The transmission ratios of gears which respectively drive the shaft 35 on the one hand and the shafts 58 on the other hand is selected in the aforementioned manner, i.e., that each inverting element 37 completes one-half of a revolution about its own axis while the turntable 36 completes a full revolution about the axis of the shaft 35. Moreover, if the shaft 35 is driven to rotate counterclockwise (arrow 74 in FIG. 3), the shafts 58 rotate clockwise (arrow 76 in FIG. 3), or vice versa.

The operation of the turn-around device 27 is as follows:

The flutes 26A of the severing conveyor 26 deliver pairs of coaxial filter cigarettes 77 of unit length into alternate flutes 28A of the conveyor 28 (see FIG. 2). The filter rod sections of pairs of cigarettes 77 in the flutes 26A are adjacent to each other, i.e., such filter rod sections face in opposite directions. The purpose of the turn-around device 27 is to invert one cigarette 77 of each pair end-for-end and to place it into an empty flute 28A of the conveyor 28 so that the inverted cigarette 77A then forms part of a single row including all of the non-inverted cigarettes. With reference to FIG. 4, the elements 37 invert the cigarettes 77 of the left-hand row of cigarettes 77 on the conveyor 28 and insert inverted cigarettes 77A between the non-inverted cigarettes 77 of the right-hand row.

When an inverting element 37 reaches the transfer station TS, its flute 39 is parallel to the inner end portion of the oncoming cigarette 77 (shown in FIG. 3 by broken lines) of a pair of cigarettes in the corresponding flute 28A of the conveyor 28. The suction port 42 of such inverting element 37 is in communication with the suction generating device through the medium of the groove 44 in the respective valve plate 43 so that the cigarette 77 is transferred onto the inverting element 37 and begins to turn therewith in the direction indicated by arrow 76 while the turntable 36 rotates in the direction indicated by arrow 74. The other (nonattracted) end portion of the cigarette 77 on the inverting element 37 extends radially outwardly away from the axis of the turntable 36. As the inverting element 37 turns in a clockwise direction, the orientation of the cigarette 77 changes from radial toward tangential with respect to the turntable 36. In the absence of any auxiliary or secondary movement of the cigarette 77, the latter would strike against or otherwise interfere with movement of adjacent (preceding) cigarette or cigarettes. Immediately after the flute 39 accepts a cigarette 77 from the conveyor 28, the corresponding roller follower 61 travels along a downwardly sloping portion of the face of the cam 62 (i.e., the roller follower 61 travels in a direction to the right and beyond the apex 66 shown in the left-hand end portion of FIG. 6). This enables the cigarette 77 to move away from ribs between the flutes 28A of the conveyor 28. At the 9 o'clock position of FIG. 3, the face of the cam 62 begins to slope upwardly toward the apex 64 (which is assumed to be located at the 3 o'clock position, as viewed in FIG. 3) whereby the cigarette 77 rises with the respective inverting element 37 and cannot interfere with movements of cigarettes on the preceding inverting elements because each preceding cigarette on the turntable 36 is located at a level above the next-following cigarette. Once the roller follower 61 reaches the apex 64, it begins to travel along a downwardly sloping portion of the face of the cam 62; however, this does not cause any contact between neighboring cigarettes on the turntable 36 because (and as clearly shown in FIG. 3) the free ends of neighboring cigarettes cease to overlie each other as soon as the corresponding inverting elements 37 advance beyond the 3 o'clock position. A freshly inverted cigarette 77A extends from its flute 39 radially inwardly toward the axis of the turntable 36 and registers with an oncoming empty flute 28A as soon as the respective inverting element 37 reaches the transfer station TS. The suction port 42 for the flute 39 at the transfer station TS then travels over a land 45 between the grooves 44, 46 of the respective valve plate 43 so that the inverted cigarette 77A is not attracted to the inverting element 37. At the same time, the cigarette 77A is attracted by one or more suction ports (not specifically shown) in the oncoming empty flute 28A whereby the cigarette 77A is transferred onto the convey 28 and advances therewith toward the transfer station between the conveyors 28 and 29. The arrow 78 (FIG. 4) indicates the direction of flow of air from the grooves 44 of the valve plates 43.

The inversion of cigarettes end-for-end is achieved as a result of a composite movement including an orbital movement about the axis of the shaft 35 and an angular movement (in opposite direction) about the axes of the respective shafts 58. The inversion is end-for-end because an element 37 turns through 180 degrees while the turntable 36 completes a full revolution.

The transfer of a freshly inverted cigarette 77A from the flute 39 of an inverting element 37 which reaches the transfer station TS takes place simultaneously or substantially simultaneously with transfer of a non-inverted cigarette 77 into the associated flute 38. The flute 38 then performs the same movement as described above for the flute 39 so that the cigarette (one end portion of which is attracted by the suction port 41) is inverted end-for-end when the corresponding inverting element 37 again reaches the transfer station TS. The inverted cigarette is transferred into an empty flute 28A while the associated flute 39 accepts a cigarette from an oncoming filled flute 28A. The same procedure is repeated again and again for each inverting element 37 as long as the conveyor 28 and turntable 36 are in motion and as long as the conveyor 26 delivers pairs of cigarettes 77 to alternate flutes 28A.

The roller follower 61 for each inverting element 37 which begins to advance beyond the transfer station TS (arrow 63 in FIG. 6) moves downwardly (along the apex 66), thereupon upwardly (toward the apex 64), downwardly (into the valley between the apices 64, 66) and again upwardly (toward the apex 66) so that the flutes 38, 39 return to the same level upon completion of each revolution of the turntable 36.

The grooves 46 of the valve plates 43 communicate with the respective ports 41 while the ports 42 communicate with the respective grooves 44, and vice versa. The provision of two discrete grooves in each valve plate 43 is desirable because this enhances the versatility of the improved turn-around device. Thus, the device 27 can invert cigarettes 77 which are nearer to the wall 34 (see FIG. 4) or the cigarettes which are nearer to the free end face of the conveyor 28. For example, and referring to FIG. 3, the turntable 36 can be rotated clockwise and the inverting elements 37 then rotate counterclockwise. A flute 38 receives a cigarette (77' in FIG. 3) at the station TS and inverts the cigarette while the turntable completes a full revolution in a clockwise direction. Such cigarette is thereupon inserted into an empty flute 28A in the upper portion of the conveyor 28, as viewed in FIG. 3. The grooves 44, 46 can be continously connected with the suction generating means because the ports which communicate with the groove 46 (while the turntable 36 rotates counterclockwise, as viewed in FIG. 3) draw air into empty flutes 38 or 39, i.e., into those flutes which have transferred inverted cigarettes 77A into empty flutes 28A and are on their way back to the station TS. Irrespective of the direction of rotation of the turntable 36, a flute 38 or 39 which moves a cigarette toward the station TS is automatically disconnected from the suction manifold 53 immediately prior to transfer of inverted cigarette 77A into an empty flute 28A. This is due to the provision of lands 45 between the grooves 44, 46 of the valve plates 43.

An important advantage of the improved turn-around device 27 is that the inverting elements 37 rotate (about the axes of the shafts 58) counter to the direction of rotation of the turntable 36. This reduces the centrifugal force which acts upon the cigarettes during the tip turning so that the cigarettes 77 are less likely to be expelled from the flutes 38 or 39 even if the turntable 36 is driven at a relatively high speed so as to process the entire output of a modern high-speed filter cigarette making machine. Moreover, the average speed of inverted cigarettes is identical with or closely approximates the speed of those ends of cigarettes which are remote from the elements 37 during inversion on the turntable 36. This is desirable because the orientation of cigarettes which are about to be transferred into an empty flute 28A or are in the process of being removed from a filled flute 28A changes negligibly; therefore, the turntable 36 can rotate in immediate proximity of the conveyor 28 and the cigarettes are not deformed during removal from or insertion into the flutes 28A.

Another important advantage of the improved turn-around device is that a single conveyor (28) can serve as a means for feeding non-inverted cigarettes 77 to the inverting elements 37 as well as a means for removing or accepting inverted cigarettes from the flutes 38 or 39. The inverted cigarettes can be placed in exact alignment with those non-inverted cigarettes 77 which remain in the respective flutes 28A during travel of such flutes from the transfer station between the drums 26, 28 to the transfer station between the drums 28, 29.

The pneumatic system which attracts the ends of cigarettes to the respective inverting elements 37 during orbital movement with such inverting elements about the axis of the shaft 35 is simple and compact which is desirable in order to reduce the energy requirements of the suction generating means. The flexible conduits 49 enable the valve plates 43 to move up and down with the respective sleeves 59 while the manifold 53 rotates with the shaft 35 and turntable 36.

The cam 62 exhibits the advantage that the extent of axial movement of the inverting elements 37 during each revolution of the turntable is extremely small and that the axial movement is gradual. This is due to the fact that the face of the cam 62 slopes downwardly immediately after the respective roller follower 61 moves beyond the transfer station TS. Thus, a freshly transferred cigarette 77 moves downwardly and away from the lowermost portion of the conveyor 28 before the face of the cam 62 begins to slope upwardly in order to stagger the neighboring cigarettes on the turntable 36 in the axial direction of the respective shafts 58 and to thus prevent such neighboring cigarettes from interfering with each other during tip turning. Since the inverting elements 37 first move downwardly and thereupon upwardly (i.e., from the apex 66 toward the apex 64), there is more room for gradual axial movement of inverting elements 37 during that critical stage of turning (between the nine and 3 o'clock positions, as viewed in FIG. 3) when the free ends of cigarettes 77 on the turntable 36 overlie each other. The second apex 66 insures that the flutes 38, 39 are sufficiently close to the flutes 28A at the station TS to guarantee a smooth transfer of non-inverted cigarettes 77 onto the elements 37 and an equally smooth transfer of cigarettes 77A from the elements 37 into the empty flutes 28A.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. A turn-around device for cigarettes or analogous rod-shaped articles, particularly a device for inverting end-for-end one filter cigarette of successive pairs of filter cigarettes of unit length which are moved sideways, comprising a support rotatable about a first axis; reorienting means including at least one inverting element mounted on and rotatable relative to said support about a second axis which is spaced from and parallel to said first axis; means for rotating said support in a first direction whereby said inverting element orbits about said first axis and moves past a transfer station once during each revolution of said support; means for rotating said inverting element about said second axis counter to said direction through 180 degrees during each full revolution of said support; means for feeding non-inverted articles to said inverting element at said transfer station whereby an article which has been fed to said element at said station is turned end-for-end during the next-following full revolution of said support; and means for removing inverted articles from said inverting element at said transfer station.

2. A device as defined in claim 1, wherein said means for feeding and said means for removing comprises conveyor means rotatable about a third axis which is normal to said first and second axes.

3. A device as defined in claim 1, wherein said inverting element has receiving means for the end portions of non-inverted articles.

4. A device as defined in claim 1, wherein said feeding and removing means constitute components of a single conveyor.

5. A device as defined in claim 1, wherein said inverting element has two receiving means one of which receives a non-inverted article at and the other of which delivers an inverted article to said station.

6. A device as defined in claim 5, wherein said receiving means are parallel flutes and flank said second axis.

7. A device as defined in claim 6, wherein said flutes form part of a substantially Z-shaped recess in said inverting element.

8. A device as defined in claim 1, wherein said first and second axes are substantially vertical and said feeding and removing means are located above said inverting element.

9. A device as defined in claim 1, wherein said feeding and removing means constitute component parts of a single rotary conveyor.

10. A device as defined in claim 9, wherein said conveyor is a drum.

11. A device as defined in claim 1, further comprising means for moving said inverting element in the direction of said second axis in response to rotation of said support about said first axis.

12. A device as defined in claim 11, wherein said means for moving said inverting element in the direction of said second axis comprises a mechanism for gradually shifting said element at least once from a predetermined axial position which said element assumes at said transfer station and back to said axial position not later than when said element returns to said station in response to a full revolution of said support about said first axis.

13. A device as defined in claim 12, wherein said mechanism comprises a stationary cam and a follower tracking said cam and being movable axially with said inverting element.

14. A device as defined in claim 13, wherein said first and second axes are substantially vertical and said cam has a track of such configuration that said element moves axially downwardly during a first stage of movement beyond said station and thereupon upwardly during a second stage of movement beyond said station.

15. A device as defined in claim 13, wherein said cam has an endless cam face with two angularly spaced apices.

16. A device as defined in claim 13, wherein said follower is a roller rotatable about an axis which is normal to said second axis.

17. A device as defined in claim 1, wherein said means for rotating said support comprises a shaft rigid with said support and defining said first axis and a first torque transmitting member connected with said shaft, said means for rotating said inverting element comprising a second torque transmitting member surrounding said first torque transmitting member and means for rotating said second torque transmitting member relative to said first torque transmitting member.

18. A device as defined in claim 17, wherein said means for rotating said inverting element further comprises a second shaft rigid with said element and defining said second axis and a pinion rigid with said second shaft, said second torque transmitting member comprising a gear meshing with said pinion.

19. A device as defined in claim 18, further comprising a bearing sleeve for said second shaft, said bearing sleeve being mounted in said support and said inverting element being rotatable with respect to said sleeve about said second axis.

20. A device as defined in claim 1, wherein each of said rotating means comprises a set of mating bevel gears.

21. A device as defined in claim 1, wherein said inverting element has at least one suction port for retaining an article while said element moves from said feeding means toward said removing means, and further comprising means for evacuating air from said port during such movement of said inverting element.

22. A device as defined in claim 21, wherein said evacuating means comprises a valve member mounted in said support and having two arcuate grooves one of which communicates with said port during the major part of each revolution of said support, said inverting element being adjacent to and being rotatable relative to said valve member about said second axis.

23. A device as defined in claim 22, wherein said evacuating means further comprises a suction manifold rigid and coaxial with said support and conduit means connecting said manifold with said grooves.

24. A device as defined in claim 23, wherein said means for rotating said support comprises a shaft rigid with said support and defining said first axis, said shaft having suction channel means communicating with said conduit means by way of said manifold.

25. A device as defined in claim 1, wherein said support is a horizontal turntable and said reorienting means comprises an annular of discrete inverting elements each of which is rotatable with respect to said support about a discrete second axis.

* * * * *